US005732773A

United States Patent [19]

Parks et al.

[11] Patent Number: 5,732,773

[45] Date of Patent: Mar. 31, 1998

[54] NON-WELDED BORE SELECTOR ASSEMBLY

[75] Inventors: William C. Parks, Katy; Michael Spiering, Kingwood, both of Tex.

[73] Assignee: Sonsub, Inc., Houston, Tex.

[21] Appl. No.: 626,489

[22] Filed: Apr. 3, 1996

[51] Int. Cl.[6] ..... E21B 23/00

[52] U.S. Cl. ..... 166/117.5; 166/242.1

[58] Field of Search ..... 166/117.5, 117.6, 166/381, 133, 143, 242.1

[56] References Cited

U.S. PATENT DOCUMENTS

| | | | |
|---|---|---|---|
| 1,870,499 | 8/1932 | Ernst | 137/625.47 |
| 2,304,303 | 12/1942 | Ferguson | 166/2 |
| 2,907,391 | 10/1959 | Kinley | 166/224 |
| 3,545,541 | 12/1970 | Devries | 166/95 |
| 3,581,768 | 6/1971 | Conti | 137/610 |
| 3,595,311 | 7/1971 | Harbonn et al. | 166/5 |
| 3,674,123 | 7/1972 | Lewis et al. | 193/23 |
| 3,780,756 | 12/1973 | Pennington | 137/119 |
| 4,063,572 | 12/1977 | Anderegg et al. | 137/862 |
| 4,133,418 | 1/1979 | Van Bilderbeek | 193/23 |
| 4,223,700 | 9/1980 | Jones | 137/874 |
| 4,224,986 | 9/1980 | Rothberg | 166/117.5 |
| 4,291,724 | 9/1981 | Miller | 137/555 |
| 4,372,337 | 2/1983 | Holzenberger | 137/240 |
| 4,606,410 | 8/1986 | Becker et al. | 166/313 |
| 4,682,656 | 7/1987 | Waters | 166/372 |
| 4,821,772 | 4/1989 | Anderson, Jr. et al. | 137/625.46 |
| 5,129,459 | 7/1992 | Breese et al. | 166/339 |
| 5,156,504 | 10/1992 | Stich et al. | 409/136 |

*Primary Examiner*—Frank Tsay

*Attorney, Agent, or Firm*—Pravel, Hewitt, Kimball & Krieger

[57] ABSTRACT

A bore selector assembly having a unitary bottom section having primary and secondary inlet passageways extending therethrough, a unitary interior section having a bore therethrough, a unitary top section with a primary outlet passageway therethrough, and an outer sleeve extending over the interior section and securing the bottom, interior and top sections together.

24 Claims, 5 Drawing Sheets

FIG. 7
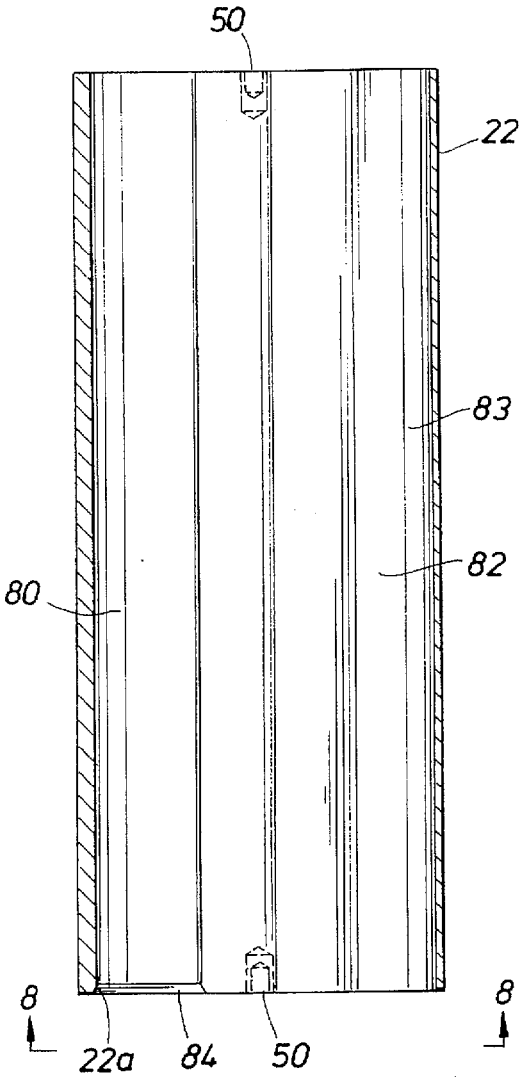
FIG. 9
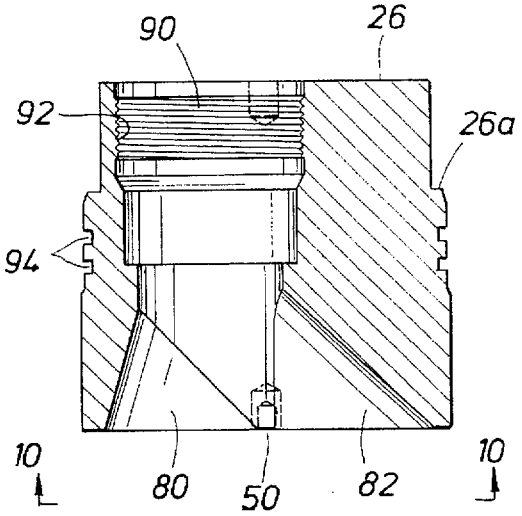
FIG. 10
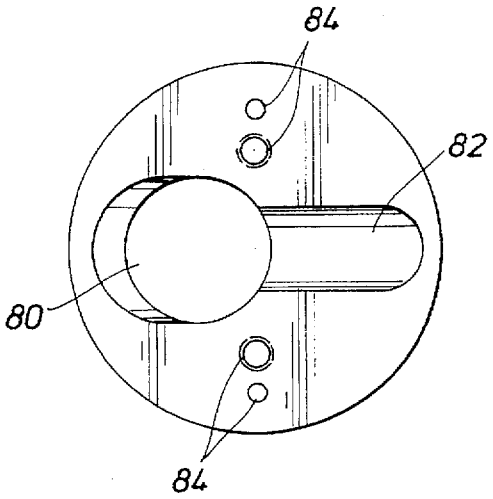
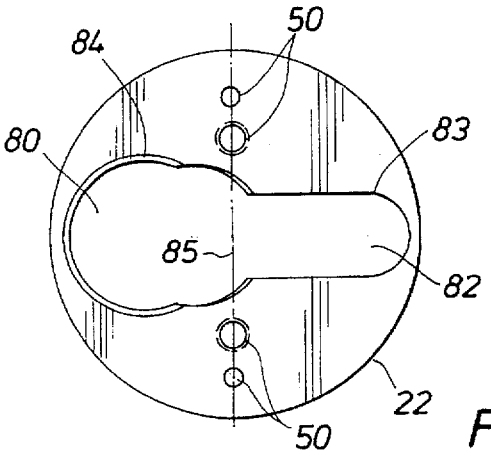
FIG. 8

FIG. 11
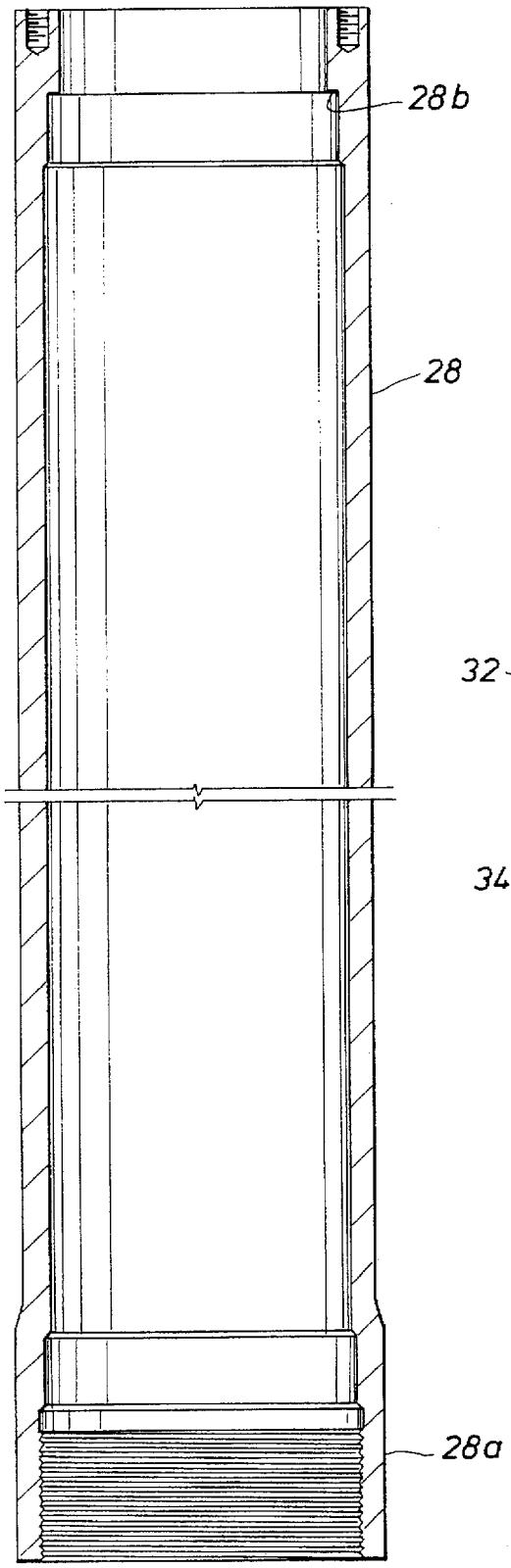
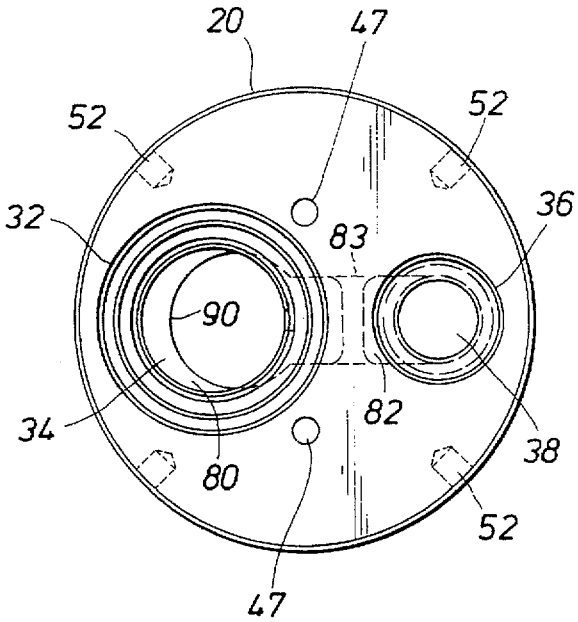
FIG. 12

NON-WELDED BORE SELECTOR ASSEMBLY

BACKGROUND OF THE INVENTION

1. Field of the Invention

The present invention relates generally to a bore selector assembly for use in wells and well servicing equipment, and more particularly to a non-welded bore selector assembly for use in high pressure wells.

2. Description of the Prior Art

Bore selector assemblies or diverter assemblies are well known in the art. Bore selector assemblies are used to access lower primary and/or secondary tubing strings from an upper primary tubing string. A bore selector assembly allows a variety of operations to be conducted on the well. For example, servicing of downhole safety valves in the primary and secondary tubing strings may be accomplished with appropriate tools lowered into the bore selector assembly as described in U.S. Pat. No. 4,606,410 to Becker et al. (hereinafter referred to as "the '410 Patent"). Additionally, venting of the annulus or casing can also be accomplished as described in the '410 Patent.

The '410 Patent discloses a diverter assembly comprising a mandrel having a tubular main body with an eccentric reducer at its upper end and a diverter shoe at its lower end. The eccentric reducer includes an upper outlet for interconnecting with a primary tubing string and the diverter shoe includes lower full bore primary and secondary inlets for interconnecting with lower primary and secondary tubing strings. Typically, the secondary inlet and secondary tubing string have smaller diameters than the primary inlet and primary tubing string.

The tubular main body of the mandrel of the diverter assembly disclosed in the '410 Patent is disclosed as a uniform wall thickness pipe having a uniform, unobstructed inside diameter through which various tools, namely a retriever tool, may be lowered to the diverter shoe. The diverter assembly provides a space within the tubular main body for an articulated or hinged running tool to "kick" or deflect and enter the desired lower primary or secondary inlet in the diverter shoe.

The tubular main body of the mandrel as disclosed in the '410 Patent is not designed to withstand high well pressures, as for example well pressures exceeding 5,000 pounds per square inch (psi). While the operational features of the diverter assembly described in the '410 Patent are functional in a high pressure well, high well pressures result in excessive stresses and failure of the diverter assembly disclosed in the '410 Patent without turning to high strength alloys and/or thick walled tubulars which are costly to weld. Additionally, the outside diameter of the diverter assembly is always limited by various well and drilling constraints.

It is desirable to have a bore selector assembly adapted for use in deep subsea applications and designed for well pressures exceeding 5,000 psi. It is desirable to have a bore selector assembly which can withstand pressures ranging from at least 5,000–15,000 psi. It is also desirable that the overall diameter of the bore selector assembly remain unchanged over the prior art bore selector assemblies while being able to withstand high well pressures. It is further desirable that the bore selector assembly be easy to manufacture, cost effective and dependable.

SUMMARY OF THE INVENTION

The bore selector assembly of the present invention is adapted for use in deep subsea applications and can withstand well pressures ranging from at least 5,000–15,000 pounds per square inch (psi). The bore selector assembly is easy to manufacture, cost effective and dependable.

The bore selector assembly is comprised of a plurality of main body sections over which a close-fitting outer sleeve is threaded. Interconnection of this assembly avoids the complexities of welding. An unanticipated benefit of the present invention is that a ½ reduction in the diameter of the overall assembly was made while providing sufficient strength to withstand high internal well pressures.

The bore selector assembly includes a bottom section which includes both primary and secondary inlets and passageways. The two passageways converge into a single, spatulated (keyhole-shaped) cavity when the bottom section is connected to a lower interior section, the second piece of the assembly. A third piece, almost identical to the second piece, is the upper interior section, which is attached to the lower interior section. The length of the inner cavity of the combined lower and upper interior sections is sufficient to accommodate the diversion of wireline running tools from an outlet at the top of the bore selector assembly into the laterally offset secondary passageway at the bottom of the assembly. The fourth piece of the assembly is a top section in which a stem chute of the spatulated cavity is reduced into a main circular cavity of the outlet.

An outer sleeve having an inner diameter approximating the outer diameter of the interior sections slides over the interconnected top and interior sections and is threadably connected to the bottom section, axially compressing the interior sections together. Seals about the bottom and top sections resist fluid pressure from escaping between those sections and the outer sleeve.

BRIEF DESCRIPTION OF THE DRAWINGS

In order to more fully understand the drawings referred to in the detailed description of the present invention, a brief description of each drawing is presented, in which:

FIG. 7 is an enlarged longitudinal sectional view of an interior section of the bore selector assembly;

FIG. 8 is a view taken along line 8—8 of FIG. 7;

FIG. 9 is an enlarged longitudinal sectional view of a top section of the bore selector assembly;

FIG. 10 is a view taken along line 10—10 of FIG. 9;

FIG. 11 is an enlarged longitudinal sectional view of an outer sleeve of the bore selector assembly; and FIG. 12 is a view taken along line 12—12 of FIG. 1.

DETAILED DESCRIPTION OF PREFERRED EMBODIMENTS

Figure 1:
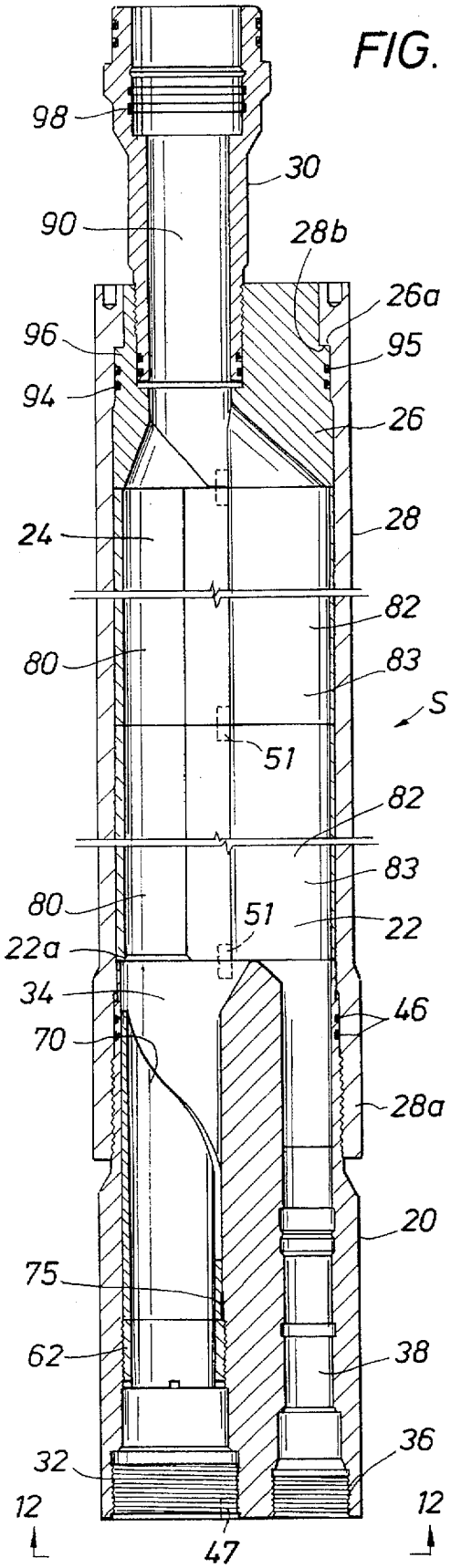
FIG. 1 is a longitudinal sectional view of the bore selector assembly according to the present invention.

Referring now to the drawings in greater detail, the bore selector assembly of the present invention, generally designated by the letter S, comprises a bottom section 20, lower and upper interior sections 22 and 24, respectively, a top section 26, an outer sleeve 28 and a stem 30 as shown in FIG. 1.

Figure 2:
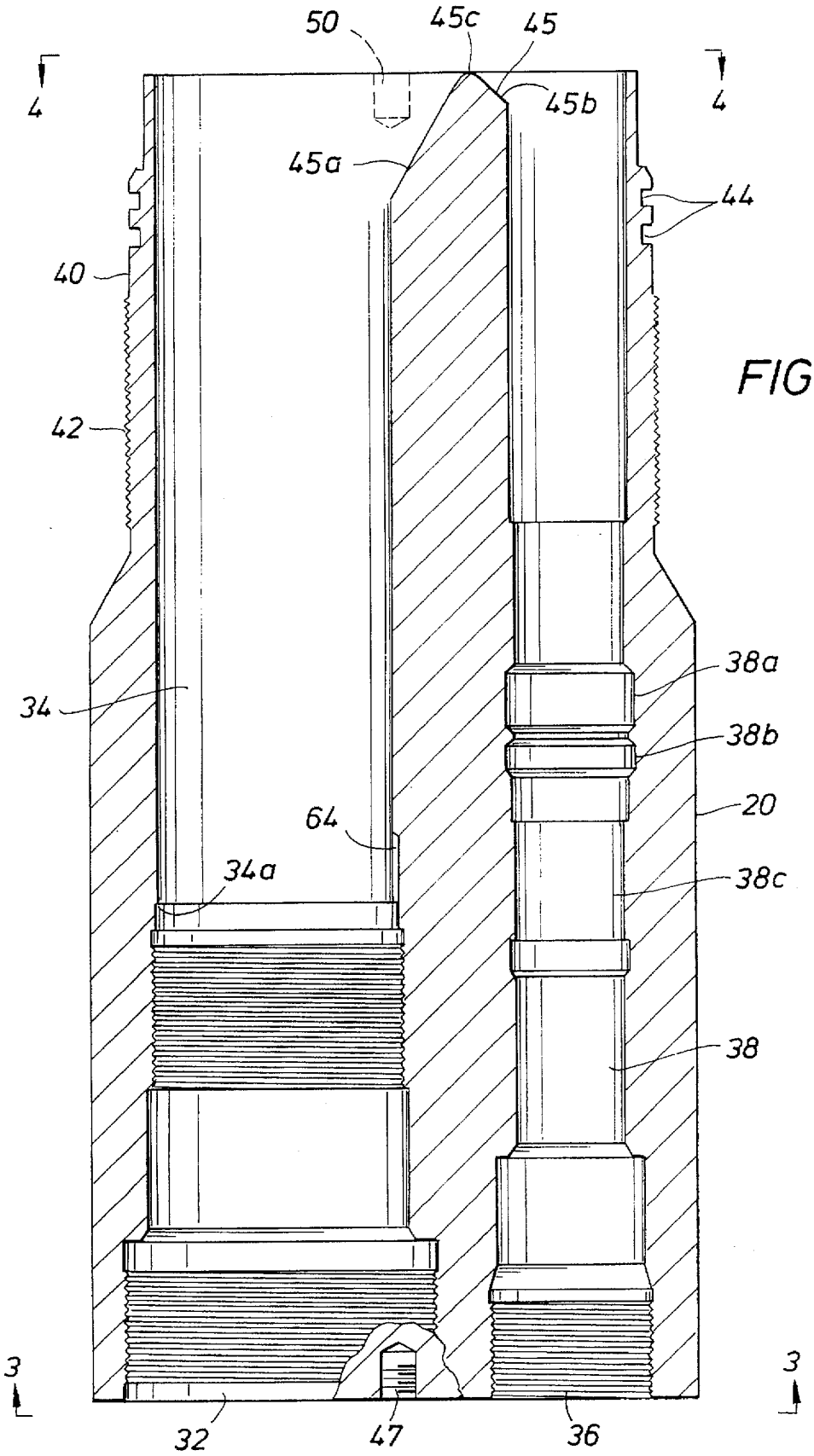
FIG. 2 is an enlarged longitudinal sectional view of a bottom section of the bore selector assembly.

Referring to FIGS. 1 and 2, the bottom section 20 of the bore selector assembly S includes a full bore primary inlet 32 and a full bore primary passageway 34 extending longitudinally through the bottom section 20. The primary inlet 32 is adapted to be connected, preferably threadably connected, to an upper end of a primary tubing string (not shown) extending down to the production zone of the well.

The bottom section 20 of the bore selector assembly S also includes a full bore secondary inlet 36 and a full bore secondary passageway 38 extending longitudinally through the bottom section 20. The secondary passageway 38 typically has a diameter less than that of the primary passageway 34 and is generally parallel with the primary passageway 34. The secondary inlet 36 is adapted to be connected, preferably threadably connected, to an upper end of a secondary or vent tubing string (not shown) extending down the hole generally parallel to the primary tubing string. Although not shown, the secondary tubing string has an open lower end positioned in an annulus above the producing formation of the well.

The internal profile of the secondary passageway 38 typically includes first and second recesses 38*a* and 38*b*, respectively, as shown in FIG. 2. The first and second recesses 38*a* and 38*b* are recesses into which a wireline lock (not shown) may be located and retained. Still referring to FIG. 2, a secondary passageway portion 38*c* is a polished bore portion having a smaller diameter than any of the various diameters of the secondary passageway 38 above that point (in the direction of recesses 38*a* and 38*b*). The polished bore portion 38*c* is provided to locate a radial seal with the wireline lock. Installation of the wireline lock into the profiles 38*a*, 38*b* and 38*c*, provides isolation between the primary and secondary passageways 34 and 38, respectively.

As shown in FIG. 2, the bottom section 20 includes an upper end 40 which has exterior threads 42 thereon for connection with an outer sleeve 28, described below, that surrounds and reinforces sections of the bore selector assembly S. The upper end 40 of the bottom section 20 also includes a pair of exterior circumferential grooves 44 for receiving seals 46 (FIG. 1 ) therein.

Figure 4:
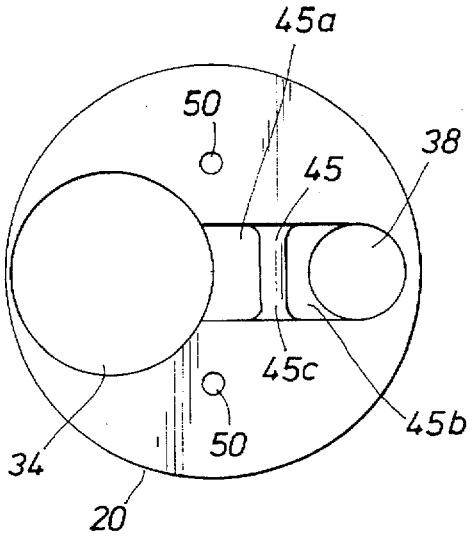
FIG. 4 is a view taken along line 4—4 of FIG. 2.

Referring to FIGS. 2 and 4, the upper end 40 of the bottom section 20 includes a diverter ramp 45 having a primary ramp face 45*a*, a secondary ramp face 45*b* and a rounded pinnacle 45*c* therebetween. The diverter ramp 45 directs or deflects and diverts well tools toward either the primary or secondary passageways 34 and 38, respectively. Large diameter tools are directed into the primary passageway 34 and small diameter kickover tools are diverted into the secondary passageway 38.

Figure 3:
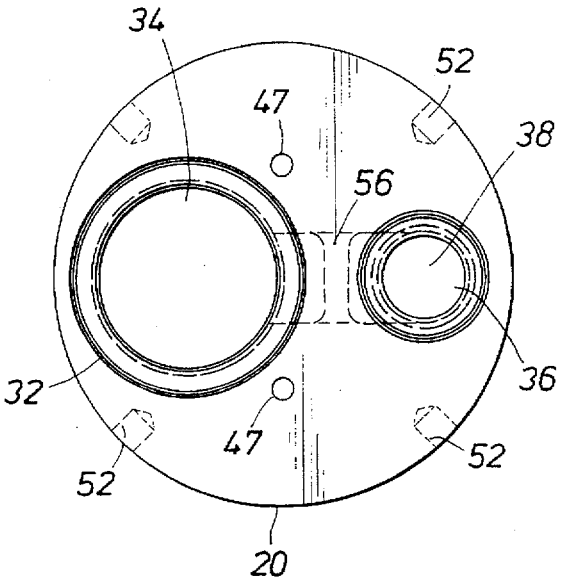
FIG. 3 is a view taken along line 3—3 of FIG. 2.

The lower end view of the bottom section 20 is illustrated by FIG. 3. The full bore primary inlet 32 and primary passageway 34 are spaced laterally from the full bore secondary inlet 36 and secondary passageway 38. The plurality of concentric circles shown about the primary and secondary passageways 34 and 38, respectively, illustrate the various internal diameters of each passageway along the length of the bottom section 20. One or more mounting sockets 52 around the perimeter of the bottom section 20 provide a means by which tools can hold or rotate the bottom section 20 to thread the outer sleeve 28 onto the bottom section 20 as will be explained below. Preferably, the mounting sockets 52 are in pairs spaced 180° around the perimeter of the bottom section 20.

Referring to FIGS. 1–3, the lower end of the bottom section 20 includes a pair of sockets 47, preferably threaded, which are provided to receive threaded bolts or eyebolts (not shown) during the assembly and handling of the bore selector assembly S.

The upper end view of the of bottom section 20 which interfaces with the lower interior section 22 is shown in FIG. 4. Two alignment sockets 50 parallel to and laterally spaced from the primary and secondary passageways 34 and 38, respectively, are provided for alignment with the lower interior section 22 of the bore selector assembly S as will be explained below. It is to be understood that other means for aligning the sections can be used, as for example, by using keys and keyways on the abutting faces of the sections.

Figure 5:
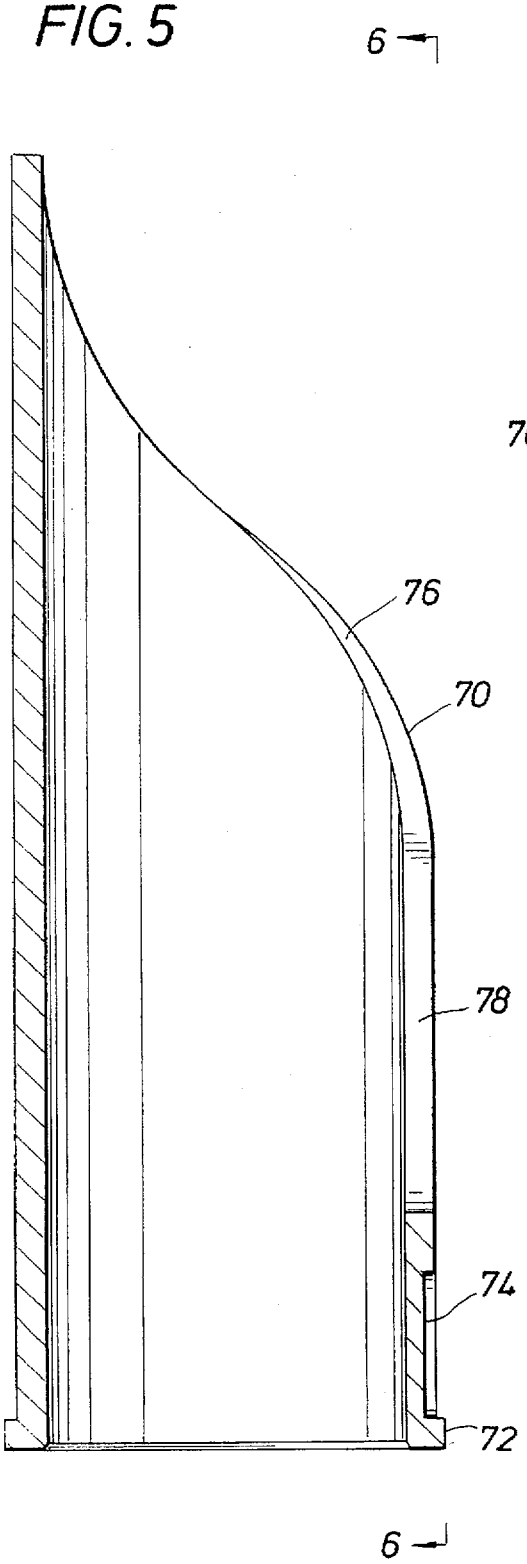
FIG. 5 is an enlarged longitudinal sectional view of an orientation sleeve of the bore selector assembly.
Figure 6:
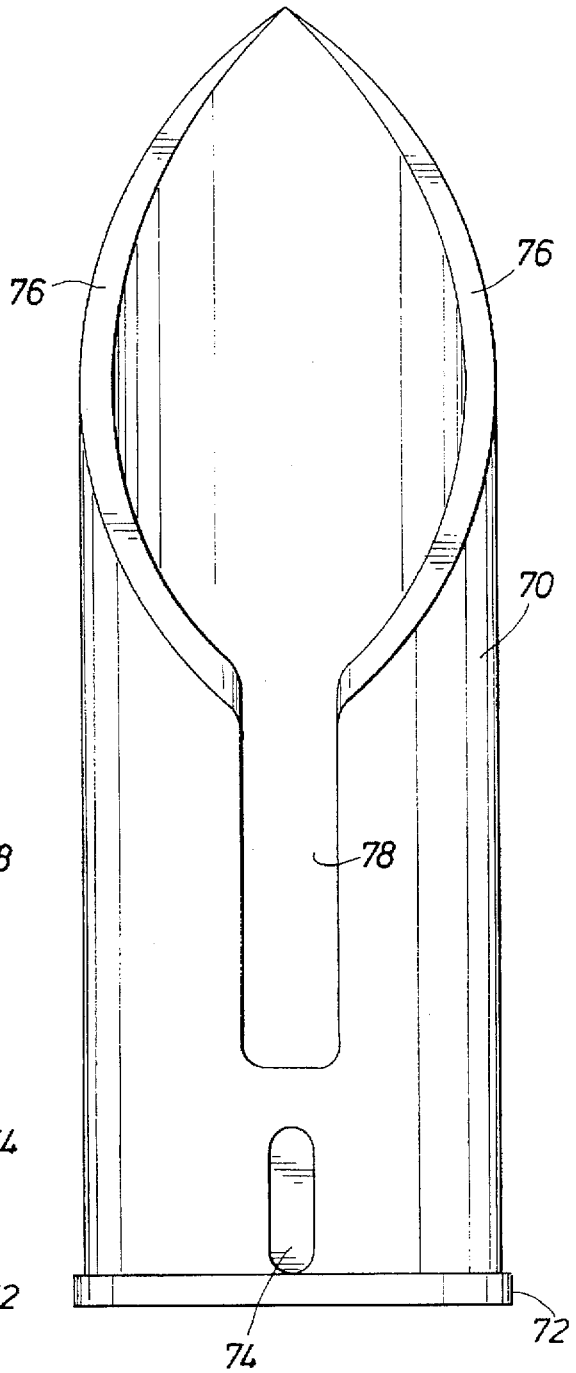
FIG. 6 is a view taken along line 6—6 of FIG. 5.

Referring now to FIGS. 5 and 6, an orientation sleeve 70 is a cylindrical member bounded at one end by a flange 72 and at the other end by two helically-tapered shoulders 76, which meet where the sleeve's length is the greatest and recede symmetrically toward a guide slot 78. Referring to FIG. 1, the orientation sleeve 70 is inserted through the primary inlet 32 into the primary passageway 34 of the bottom section 20. The flange 72 of the orientation sleeve 70 abuts a sleeve shoulder 34*a* (FIG. 2) in the bottom section 20. The flange 72 and sleeve shoulder 34*a* prevent the sleeve 70 from being inserted too far into the primary passageway 34. A key 75 (FIG. 1 ) fits within a recess 74 (FIGS. 5 and 6) of the sleeve 70 and a slot 64 (FIG. 2) of the primary passageway 34 to maintain the correct rotational orientation of the sleeve 70. A retaining nut 62 is threaded into the primary passageway 34 to secure the longitudinal placement of the orientation sleeve 70. Once properly inserted into the bottom section 20, the orientation sleeve 70 functions as a guide shoe to position a whipstock plug or other tubing-retrievable device to a proper rotational orientation.

Referring to FIG. 1, the lower and upper interior sections, 22 and 24, respectively, of the bore selector assembly S provide the length sufficient to accommodate the diversion of wireline running tools from the outlet 90 at the top of the assembly S into the laterally offset secondary passageway 38 at the bottom of the assembly S. Referring to FIGS. 7 and 8, both the lower and upper interior sections 22 and 24, respectively, include a spatulated passageway 82 herein described as a U-shaped chamber or chute 83 connected to a larger main cavity 80. The effective diameter of the U-shaped chamber 83 keeps retrieving tools of greater diameter in the main cavity 80, directing them to the primary passageway 34 of the bottom section 20.

The upper and lower interior sections 24 and 22 are connected to the lower interior and bottom sections 22 and 20, respectively, by means of alignment pins 51 (FIG. 1 ) placed in the sockets 50 of the said sections. The alignment pins 51 and sockets 50 ensure proper rotational alignment of the various components of the bore selector assembly S. Due to the design of the bore selector assembly S it is very important that the components be assembled and oriented in a particular arrangement as shown in FIG. 1. As shown in FIG. 1, lower and upper interior sections 22 and 24, respectively, are stacked above the bottom section 20. Referring to FIGS. 7 and 8, the end of the main cavity 80 of the lower interior section 22 is tapered 22*a* to mate with the primary passageway 34 of the bottom section 20. The upper interior section 24 is identical to the lower interior section 22 of FIG. 7, with the exception that the main cavity 80 is not tapered at the end.

Referring to FIG. 8, the interior section 22 is a substantially solid steel cylinder through which the spatulated passageway 82 is formed. In the preferred embodiment of the invention, the spatulated passageway 82 is machined out of the solid steel cylinders to form the interior sections 22 and 24. Such machining can be conducted by boring the steel cylinders to form the passageway 82. Forming the interior sections 22 and 24 in this manner limits the length of the interior section 22 or 24 to approximately 3–4' with conventional boring equipment. Alternatively, the passageway 82 can be formed in the interior section 22, 24 by longitudinally splitting the steel cylinder into two halves and milling the passageway 82 into the pair of halves. Preferably, when using the milling technique to form the passageway 82, the steel cylinder is split into two semi-circular cross sectional members at line 85 in FIG. 8. Upon completion of the milling, the pair of halves are brought together to form the interior section 22 or 24. It is anticipated that welding of the pair of halves together is not necessary to the integrity of the assembled bore selector assembly S. The milling technique permits the interior section to be formed in a longer length typically than the machining technique. The milling technique permits the interior section to be formed from a single length bore selector steel cylinder.

It is to be understood that the interior section of the bore selector assembly S can comprise a single section or a plurality of sections and is not limited to the upper and lower interior sections 24 and 22 as described above and shown in the drawings. If a single section is suitable, it would preferably be similar to lower interior section 22 as shown in FIGS. 1, 7, and 8. If three or more sections are required, the lower section would be similar to lower interior section 22 and the other sections would be similar to upper interior section 24.

Referring to FIGS. 1, 9 and 10, the top section 26 provides the outlet 90 into which the spatulated passageway 82 of the bore selector assembly S converges. Alignment sockets 50 and alignment pins 51 allow mounting and alignment of the top section 26 onto the upper interior section 24. In the top section 26, the U-shaped chamber 83, described in the above explanation of the interior sections 22 and 24, is reduced until it merges completely with the main cavity 80. Moreover, the main cavity 80 is reduced and axially diverted toward the outlet 90 of the top section 26. Threads 92 are provided on the inside of the outlet 90 for connection with the stem 30. Circumferential grooves 94 that circle the top section 26 are fitted with rings 95 (FIG. 1 ) to seal the connection between the outer sleeve 28 and the top section 26. The top section 26 includes an exterior shoulder 26*a* for reasons which will be explained below.

The outer sleeve 28, shown separately in FIG. 11, is fitted over the lower and upper interior sections 22 and 24, respectively, the top section 26, and threadedly connected with the bottom section 20. The assembly of the top, bottom, upper interior and lower interior sections, 26, 20, 24, and 22, respectively, with the outer sleeve 28 is accomplished without welding. At its base 28*a*, the outer sleeve 28 widens to fit over the bottom section 20 by means of a threaded connection. The fit is secured against extreme fluid pressures by means of seals 46, preferably O-rings and backup rings, placed in the circumferential grooves 44. At the upper end of the outer sleeve 28 is an interior shoulder 28*b* which is adapted to abut with the exterior shoulder 26*a* of the top section 26 as shown in FIG. 1.

The final section in the bore selector assembly S is the stem 30 (FIG. 1). The stem 30 is threaded into the top section 26, providing an interface with elements above the bore selector assembly S in the well. The stem 30 includes circumferential grooves, both external 96 and internal 98, to seal connections with the top section 26 and other well assembly elements. The bore selector assembly S is assembled in the following manner. The orientation sleeve 70 of FIG. 5 is fitted into the bottom section 20. The bottom section 20 is aligned and held in place with the key 75 and the retaining nut 62. The seals 46 are placed in the circumferential grooves 44 of the bottom section 20. The bottom section 20 is uprighted on a level surface with the upper end 40 pointed upward. The lower interior section 22 is placed or stacked on top of the upper end 40 of the bottom section 20 and aligned and connected via the alignment pins 51. The upper interior and top sections, 24 and 26, respectively, are connected in similar fashion. The seals 95 are placed in the circumferential grooves 94 of the top section 26 before the top section 26 is placed on the upper section 24. The outer sleeve 28 is then lowered over sections 26, 24, and 22 and threadedly connected with the bottom section 20. The interior shoulder 28*b* of the outer sleeve 28 bears against the exterior shoulder 26*a* of the top section 26. The outer sleeve 28 is permitted to rotate relative to the top section 26, the interior sections 24 and 22, and the bottom section 20. As the outer sleeve 28 rotates and threadedly connects with the bottom section 20, the interior sections 24 and 22 are put in slight axial compression between the top and bottom sections 26 and 20, respectively. It is to be understood that the actual axial compressive force on the interior sections 24 and 22 is small and operation of the bore selector assembly S is not affected when there is no axial compressive force on the interior sections 24 and 22. The outer sleeve 28 withstands the internal pressure to which the bore selector assembly S is subjected.

FIG. 12 is a view showing the relative location of the various bores and passageways through the length of bore selector assembly S. The plurality of concentric circles shown about the primary and secondary passageways 34 and 38, respectively, illustrate the various internal diameters of each passageway along the length of the bottom section 20. The eccentric circle 90 represents the superimposition of the outlet 90 of the end section 30 over the primary passageway 34 of the bottom section 20, showing that the primary passageway 34 is axially offset from the top section outlet 90. The dashed lines 83 connecting the two passageways 34 and 38 show the U-shaped chamber 83 of the spatulated passageway 82 in the interior sections 22 and 24. It is to be understood that the bore selector assembly S of the present invention can be used in the same manner as described in U.S. Pat. No. 4,606,410 and Applicant thus incorporates the '410 Patent by reference. It is to be understood that the bore selector assembly S of the present invention is a very high strength assembly which can withstand well pressures as high as 15,000 psi. The bore selector assembly S of the present invention eliminates high strength materials and costly welding which would have to be utilized with the design of the '410 Patent to withstand such high well pressures.

The foregoing disclosure and description of the invention is illustrative and explanatory thereof, and various changes in the size, shape, and materials, as well as in the details of illustrative construction and assembly, may be made without departing from the spirit of the invention.

What is claimed is:

1. In a bore selector assembly including a, substantially tubular outlet at one end and two substantially tubular inlets at the other end, the improvement comprising:

a plurality of stationary, unitary sections having a longitudinal passageway therethrough, said longitudinal passageway in fluid communication with the substantially tubular outlet and the two substantially tubular inlets; and a cylindrical outer sleeve extending over said plurality of unitary sections and firmly securing said plurality of unitary sections into close abutting contact.

2. The bore selector assembly of claim 1, wherein said plurality of unitary sections comprises:

a top section;

a bottom section; and an interior section.

3. The bore selector assembly of claim 2, wherein said interior section has an outer diameter and said outer sleeve has an inner diameter, said inner diameter of said outer sleeve closely approximating said outer diameter of said interior section.

4. The bore selector assembly of claim 2, wherein said longitudinal passageway of said interior section has a spatulated shape.

5. The bore selector assembly of claim 2, wherein each of said top, bottom and interior sections include aligned sockets for receiving alignment pins to ensure the proper rotational orientation of said sections relative to one another.

6. The bore selector assembly of claim 2, wherein one of said top and bottom sections includes a threaded portion and the other of said top and bottom sections includes an external shoulder, said outer sleeve has a threaded end and an internal flanged end, wherein said internal flanged end abuts said external shoulder and said threaded end engages said threaded portion.

7. The bore selector assembly of claim 2, wherein said top and bottom sections include outer circumferential grooves and seal rings within said outer circumferential grooves forming a fluid-tight seal between said outer sleeve and said top and bottom sections.

8. The bore selector assembly of claim 2, wherein said interior section includes an upper interior section and a lower interior section.

9. A bore selector assembly comprising:

a unitary bottom section having primary and secondary inlet passageways extending therethrough;

a unitary interior section having a bore therethrough;

a unitary top section with a primary outlet passageway therethrough; and an outer sleeve extending over said interior section and securing said bottom, interior and top sections together, wherein said primary and secondary inlet passageways are in concurrent fluid communication with said bore and said bore is in fluid communication with said primary outlet passageway.

10. The bore selector assembly of claim 9, wherein said interior section is positioned on top of said bottom section and said top section is positioned on top of said interior section.

11. The bore selector assembly of claim 10, wherein said interior section has an outer diameter and said outer sleeve has an inner diameter, said inner diameter of said outer sleeve closely approximating said outer diameter of said interior section.

12. The bore selector assembly of claim 9, wherein said bore of said interior section has a spatulated shape.

13. The bore selector assembly of claim 9, wherein each of said top, bottom and interior sections include aligned sockets for receiving alignment pins to ensure the proper orientation of said sections relative to one another.

14. The bore selector assembly of claim 9, wherein one of said top and bottom sections includes a threaded portion and the other of said top and bottom sections includes an external shoulder, said outer sleeve has a threaded end and an internal flanged end, wherein said internal flanged end abuts said external shoulder and said threaded end engages said threaded portion to tightly compress said top, interior and bottom sections together.

15. The bore selector assembly of claim 9, wherein said top and bottom sections include outer circumferential grooves and seal rings within said outer circumferential grooves forming a fluid-tight seal between said outer sleeve and said top and bottom sections.

16. The bore selector assembly of claim 9, wherein said interior section includes an upper interior section and a lower interior section.

17. The bore selector assembly of claim 9, wherein said interior section is a solid cylinder having said bore fabricated therethrough.

18. A high pressure bore selector assembly comprising:

a diverter assembly comprising:

a unitary bottom section having primary and secondary inlet passageways extending therethrough;

a unitary interior section having a bore therethrough; and a unitary top section with a primary outlet passageway therethrough, wherein said primary and secondary inlet passageways are in fluid communication with said bore and said bore is in fluid communication with said primary outlet passageway; and a pressure containing outer sleeve extending over said interior section and securing said diverter assembly together.

19. The bore selector assembly of claim 18, wherein said interior section is adjacently above said bottom section and said top section is adjacently above said interior section.

20. The bore selector assembly of claim 19, wherein one of said top and bottom sections includes a threaded portion and the other of said top and bottom sections includes an external shoulder, said outer sleeve has a threaded end and an internal flanged end, wherein said internal flanged end abuts said external shoulder and said threaded end engages said threaded portion to tightly compress said top, interior and bottom sections together.

21. The bore selector assembly of claim 20, wherein said top and bottom sections include outer circumferential grooves and seal rings within said outer circumferential grooves forming a fluid-tight seal between said outer sleeve and said top and bottom sections.

22. A high pressure bore selector assembly comprising:

a diverter assembly comprising a plurality of non-welded, unitary sections having a passageway extending from a tubular outlet at a first end of said diverter assembly to two tubular inlets at a second end of said diverter assembly; and a pressure containing outer sleeve extending over said plurality of non-welded, unitary sections and securing said plurality of non-welded, unitary sections in abutting relationship to one another.

23. The bore selector assembly of claim 22, wherein said plurality of non-welded, unitary sections include top, bottom and interior sections and each of said top, bottom and interior sections include sockets for receiving alignment pins to ensure the proper orientation of said sections relative to one another.

24. The bore selector assembly of claim 23, wherein said interior section has an outer diameter and said outer sleeve has an inner diameter, said inner diameter of said outer sleeve closely approximating said outer diameter of said interior section.

* * * * *